United States Patent [19]

Zaremski

[11] 4,363,709

[45] Dec. 14, 1982

[54] HIGH CURRENT DENSITY, ACID-FREE ELECTROLYTIC DESCALING PROCESS

[75] Inventor: Donald R. Zaremski, Cheswick, Pa.

[73] Assignee: Allegheny Ludlum Steel Corporation, Pittsburgh, Pa.

[21] Appl. No.: 238,896

[22] Filed: Feb. 27, 1981

[51] Int. Cl.[3] ..... C25F 1/06

[52] U.S. Cl. ..... 204/145 R

[58] Field of Search ..... 204/145 R, 141.5

[56] References Cited

U.S. PATENT DOCUMENTS

| | | | |
|---|---|---|---|
| 1,041,790 | 10/1912 | Herrmann | 204/145 |
| 1,865,470 | 7/1932 | Hogaboom et al. | 204/145 |
| 2,174,722 | 10/1939 | Herrmann | 204/145 |
| 3,043,758 | 7/1962 | Machu | 204/145 |
| 3,338,809 | 8/1967 | Stricker | 204/145 |
| 3,926,767 | 12/1975 | Brendlinger et al. | 204/206 |
| 4,012,299 | 3/1977 | Zaremski et al. | 204/141.5 |
| 4,026,777 | 5/1977 | Zaremski et al. | 204/141.5 |
| 4,035,256 | 7/1977 | Brendlinger | 204/145 R |
| 4,066,521 | 2/1978 | Zaremski et al. | 204/141.5 |

FOREIGN PATENT DOCUMENTS

| | | | |
|---|---|---|---|
| 277793 | 9/1911 | Fed. Rep. of Germany | 204/145 R |
| 2812576 | 9/1978 | Fed. Rep. of Germany | 204/145 R |

*Primary Examiner*—T. Tufariello

*Attorney, Agent, or Firm*—Patrick J. Viccaro

[57] ABSTRACT

A process for removing an oxide scale from the surface of a metallic body is disclosed comprising the steps of providing an electrolyte consisting of an aqueous solution containing about 15 to 25 weight percent sodium sulfate, maintaining the electrolyte at a temperature of at least 150° F., and immersing the metallic body into the electrolyte such that the surface to be descaled is exposed to the electrolyte. During immersion, the metallic body is subjected as the anode to the action of a direct electric current for a period of at least 10 seconds at a current density of at least 3 amperes per square inch.

13 Claims, No Drawings

HIGH CURRENT DENSITY, ACID-FREE ELECTROLYTIC DESCALING PROCESS

BRIEF SUMMARY OF THE INVENTION

The present invention pertains to new and improved descaling process, and more particularly, to a method of removing oxide scale from the surface of a metallic body in an electrolyte without the necessity of using an acid bath, by employing a relatively high current density.

The manufacture of most metallic products typically includes an annealing, welding, or other heat treating operation. Since such annealing, welding or other heat treating operations are commonly performed in an oxidizing atmosphere an oxide scale is formed on the surface of the metal. Such scale must be removed from the metal surface.

Various methods of removing oxide scale from metallic surfaces are known in the art. Common descaling techniques involve pickling in acids. For example, successive immersion of a metallic body into baths containing about 5–20%, by weight, of sulfuric acid, hydrochloric acid and combinations of nitric acid and hydrofluoric acid has been known to remove the oxide scale which forms on metallic surfaces. The trend in the art, as disclosed in U.S. Pat. Nos. 4,012,299; 4,026,777 and 4,066,521 has been to reduce the requirement for acid pickling for a number of reasons. The use of an acid pickle operation requires auxiliary equipment including exhaust systems, fume scrubbers, acid storage tanks and the like, and also requires elaborate programs for the disposal of the acids. The art mentioned above has significantly reduced the acid pickling requirements by employing an electrolytic treatment. Such electrolytic treatment is taught in U.S. Pat. No. 3,043,758. Despite the teachings of the prior art, there is still an objective to eliminate acid pickling completely.

Accordingly, the present invention provides a method of descaling a metallic body without the use of acid solutions by employing a relatively high current density in an electrolyte consisting of an aqueous solution containing about 15 to 20 weight percent sodium sulfate. The prior art, including U.S. Pat. Nos. 1,041,790; 1,865,470; 2,174,722; 3,338,809; 3,926,767 and German Patent No. 277,793, has suggested the use of relatively high current density for descaling, but such references do not suggest that descaling may be accomplished at such current densities with the electrolyte of the present invention, within the descaling times of the present invention.

The present invention may be summarized as providing a process for removing oxide scale from the surface of a metallic body comprising the steps of providing an electrolyte consisting of an aqueous solution containing about 15 to 25 weight percent sodium sulfate, maintaining the electrolyte at a temperature of at least about 150° F., and immersing the metallic body into the electrolyte such that the surface to be descaled is exposed to the electrolyte. During immersion, the metallic body is subjected as the anode to the action of a direct electric current for a period of at least 10 seconds at a current density of at least 3 amperes per square inch.

Among the advantages of the present invention is the provision of a descaling process which eliminates the need for acid pickling.

It follows that an advantage of this invention is the elimination of the auxiliary equipment which is required to handle, store and treat acids, acid fumes and the like, and the elimination of burdensome disposal operations for mineral acids.

These and other objectives and advantages of the present invention will be more fully understood and appreciated with reference to the following detailed description.

DETAILED DESCRIPTION

The process of the present invention results in the substantially complete removal of oxide scale from the surface of a metallic body. In the manufacture of metal products including strip, wire, rod, bar, tubing, including welding tubing, and other products, the metal is often annealed, welded or subjected to other heat treating operations. The operations are typically performed, at least in part, in an oxidizing atmosphere which causes an oxide scale to form on the surface of the metal. Oxide scale formation is a typical result of annealing or welding of alloy steels, such as stainless steels including, for example, Type 304, 316 and 409 stainless steel. The process of the present invention may also be employed to remove scale from high chromium ferritic alloys, however such alloys may have to be thoroughly cleaned prior to the annealing operation or non-uniform heavy oxide scales, including chromium oxide ($Cr_2O_3$) may be formed during annealing, which may be difficult to remove completely.

In the process of the present invention an electrolytic bath is prepared. Such bath consists of an aqueous solution containing about 15 to 25 percent sodium sulfate ($Na_2SO_4$), by weight, to provide an electrolyte. The 15–25 weight percent sodium sulfate is the equivalent of about 150 to 250 grams of sodium sulfate per liter of solution.

During the descaling process of the present invention, the bath is maintained at an elevated temperature typically on the order of at least about 150° F. (65.6° C.). Preferably, the electrolytic bath is maintained at a temperature within the range of about 160° F. to 180° F. (71° C. to 82° C.).

While the electrolytic bath is maintained at the desired temperature, the surfaces of the metallic body to be descaled are immersed into the bath. It should be understood by those skilled in the art that such immersion may be accomplished by a batch process or by a continuous process. Also, partial immersion of a metallic body may be sufficient in instances where only that portion of the metallic body requires descaling.

During the electrolytic descaling process of the present invention, the immersed metallic body must be subjected as the anode to the action of a direct electric current. This may be accomplished by applying direct electrical contact to the immersed metallic body in which case only a single anodic exposure is necessary. Alternatively, a bi-polar electrolytic system may be utilized wherein the polarity of the metallic body should be cycled at least once from cathode to anode. The immersed metallic body to be descaled must be anodically charged for a period of at least 10 seconds in the process of the present invention. It has been found that cathodic treatments have no influence on the descaling reactions in the process of the present invention. Ten (10) seconds is considered to be the minimum time period required to adequately descale the surface of a metallic body in the electrolytic bath and at the current density discussed below. The minimum descaling times required to substantially descale a metallic body typically fall within the range of from about 10 to about 60 seconds. It should be appreciated that the immersion times are dependent upon variables including actual current density and the actual electrolyte temperature. It has been found that the descaling times may be reduced as higher current densities and higher electrolyte bath temperatures are employed.

In accordance with the present invention, a metallic body is considered to be substantially descaled when at least 80% of the oxide scale has been removed from the surface. Preferably, 100% of the scale is removed from the surface of the metallic body by the process of the present invention.

The current density employed in the electrolytic descaling process of the present invention is considered to be significantly higher than the current densities utilized in conventional electrolytic descaling processes. Such high current densities in an electrolytic bath surprisingly results in substantially complete scale removal from the surface of a metallic body. The current density applied in the present invention is at least 3 amperes per square inch (46.5 amps/dm$^2$), and typically falls within the range of 3 amps/in$^2$ to about 20 amps/in$^2$ (310 amps/dm$^2$).

After descaling in accordance with the acid free electrolytic treatment of the present invention, it is not necessary to wash residue from the metallic body. However, it may be desirable, subsequently, to rinse the aqueous solution of sodium sulfate and the removed oxide scale residue from the surface of the metal. Such rinse typically employs water.

The following examples are representative of the process of the present invention. In all examples, the aqueous electrolyte contained 15–20%, by weight, sodium sulfate; and the bath temperature was maintained between 150° and 170° F. throughout the testing periods.

EXAMPLE 1

Type 304 stainless steel tubing, 1 inch diameter by 5 inch in length, was resistance annealed. Such anneal caused an oxide scale to be formed on the outside surface of the tubing. The tubing was immersed into an aqueous electrolytic bath containing 15–20%, by weight, sodium sulfate. The current density and the anodic exposure times were varied with the following results:

| Sample | Current Density (Amps/In$^2$) | Anodic Exposure Time (Sec.) | Scale Removal (%) |
|---|---|---|---|
| 1 | 3 | 60 | 100 |
| 2 | 3 | 60 | 100 |
| 3 | 3 | 45 | 80–90 |
| 4 | 3 | 30 | 80–90 |
| 5 | 4 | 60 | 100 |
| 6 | 4 | 30 | 100 |
| 7 | 5 | 30 | 100 |
| 8 | 6 | 30 | 100 |
| 9 | 8 | 30 | 100 |
| 10 | 10 | 30 | 100 |
| 11 | 10 | 15 | 100 |

Such results indicate that substantially complete scale removal may be accomplished at a minimum current density of 3 amps/in$^2$ and at a minimum anodic exposure time of at least 15 seconds.

EXAMPLE 2

Ten (10) foot long sections of Type 304 stainless steel tubing, one inch in diameter, were resistance annealed, providing an oxide scale on the outside surface of such tubing. The tubing was immersed in a continuous processing electrolytic bath, able to run at speeds of from 2 ft./min. (0.61 m/min) to 4.5 ft./min. (1.5 m/min.) thereby able to anodically expose the tubing for exposure times of from 10 seconds to 39 seconds. DC current was applied by way of a conventional bi-polar electrolytic system using two raised electrode compartments. The first compartment gave the tubing a cathodic exposure, and the second compartment gave the tubing an anodic exposure through which scale removal is accomplished. Complete descaling was obtained with an anodic current density of 3.6 amps/in$^2$ (55.8 amps/dm$^2$) when applied for a period of thirty (30) seconds.

EXAMPLE 3

Type 439 stainless steel tubing, 3/16 inch in diameter, and ten feet long was welded. The welding operation produced a residual weld scale on the tubing. Such scale renders the tubing unacceptable for certain applications, such as automotive wheel spoke applications. Using a continuous process, complete removal of the weld scale was obtained using an applied current density of 3.75 amps/in$^2$ (58.2 amps/dm$^2$) for a period of 39 seconds. These descaled samples were subsequently tested for 100 hours in a 5% neutral salt spray cabinet to determine resistance to rusting. No evidence of rusting was found after such tests.

EXAMPLE 4

Type 304 flat rolled stainless steel strip was annealed in a furnace atmosphere, which caused a heavy oxide scale to form on the surface of the strip. The strip samples were immersed into an aqueous electrolytic bath containing about 20%, by weight, sodium sulfate. The current density and the anodic exposure times were varied with the following results:

| Sample | Gage (Inch) | Current Density (Amps/In$^2$) | Anodic Exposure Time (Sec.) | Scale Removal (%) |
|---|---|---|---|---|
| 1 | .072 | 5.0 | 15 | 70 |
| 2 | .072 | 5.0 | 30 | 90 |
| 3 | .072 | 6.5 | 15 | 95 |
| 4 | .072 | 7.5 | 15 | 80 |
| 5 | .072 | 7.5 | 30 | 100 |
| 6 | .072 | 9.0 | 15 | 95 |
| 7 | .072 | 10.0 | 10 | 70 |
| 8 | .072 | 10.0 | 15 | 95 |
| 9 | .072 | 10.0 | 20 | 90 |
| 10 | .072 | 10.0 | 30 | 100 |
| 11 | .072 | 10.0 | 45 | 100 |
| 12 | .072 | 12.0 | 15 | 100 |
| 13 | .072 | 15.0 | 10 | 85 |
| 14 | .072 | 15.0 | 20 | 100 |
| 15 | .050 | 5.0 | 15 | 70 |
| 16 | .050 | 5.0 | 30 | 95 |
| 17 | .050 | 6.5 | 15 | 95 |
| 18 | .050 | 7.5 | 15 | 95 |
| 19 | .050 | 7.5 | 30 | 100 |
| 20 | .050 | 10.0 | 10 | 100 |
| 21 | .050 | 10.0 | 15 | 100 |
| 22 | .050 | 10.0 | 20 | 100 |
| 23 | .050 | 10.0 | 30 | 100 |
| 24 | .050 | 10.0 | 45 | 100 |
| 25 | .050 | 12.0 | 15 | 100 |
| 26 | .050 | 15.0 | 10 | 100 |

-continued

| Sample | Gage (Inch) | Current Density (Amps/In$^2$) | Anodic Exposure Time (Sec.) | Scale Removal (%) |
|---|---|---|---|---|
| 27 | .050 | 20.0 | 10 | 100 |

EXAMPLE 5

Type 409 flat rolled stainless steel strip was annealed in a furnace atmosphere which caused a heavy oxide scale to form on the surface of the strip. The strip samples were immersed into an aqueous electrolytic bath containing about 20%, by weight, sodium sulfate. The current density and the anodic exposure times were varied with the following results:

| Sample | Gage (Inch) | Current Density (Amps/In$^2$) | Anodic Exposure Time (Sec.) | Scale Removal (%) |
|---|---|---|---|---|
| 1 | .073 | 2.5 | 15 | 80 |
| 2 | .073 | 2.5 | 30 | 80 |
| 3 | .073 | 3.75 | 15 | 80 |
| 4 | .073 | 3.75 | 30 | 75 |
| 5 | .073 | 5.0 | 30 | 90 |
| 6 | .073 | 6.0 | 10 | 90 |
| 7 | .073 | 7.5 | 20 | 90 |
| 8 | .073 | 7.5 | 20 | 95 |
| 9 | .073 | 10.0 | 10 | 95 |
| 10 | .073 | 10.0 | 20 | 100 |
| 11 | .073 | 12.5 | 15 | 100 |
| 12 | .030 | 10.0 | 10 | 100 |
| 13 | .030 | 10.0 | 15 | 100 |
| 14 | .030 | 10.0 | 30 | 100 |
| 15 | .030 | 10.0 | 45 | 100 |

The results shown in Examples 4 and 5 above indicate that higher current densities and/or longer anodic exposure times may be required in some instances in order to effect substantially complete removal of the heavy oxide scale that forms on strip which has been annealed in a furnace atmosphere.

Whereas, the preferred embodiments of the present invention have been described above for the purposes of illustration, it will be apparent to those skilled in the art that certain variations of the details may be made without departing from the invention.

I claim:

1. A process for removing an oxide scale from the surface of a metallic body comprising the steps of:

providing an electrolyte consisting of an aqueous solution containing about 15 to 25 percent, by weight, sodium sulfate, maintaining the electrolyte at a temperature of at least about 150° F., immersing the metallic body into the electrolyte such that the surface to be descaled is exposed to the electrolyte, subjecting the metallic body as the anode to the action of a direct electric current for a period of at least 10 seconds at a current density of at least 3 amperes per square inch until the metallic body is substantially descaled, and removing the metallic body from the electrolyte.

2. A process as set forth in claim 1 including the subsequent step of rinsing the metallic body with water.

3. A process as set forth in claim 1 wherein the metallic body is subjected as the anode to the action of a direct electric current for a minimum period of from 10 to 60 seconds.

4. A process as set forth in claim 1 wherein the current density is from 3 to 20 amperes per square inch.

5. A process as set forth in claim 1 wherein the electrolyte is maintained at a temperature of from 160° to 180° F.

6. A process as set forth in claim 1 wherein the metallic body is an alloy steel.

7. A process as set forth in claim 1 wherein the metallic body is stainless steel.

8. A process as set forth in claim 1 wherein the metallic body is stainless steel in a form of strip.

9. A process as set forth in claim 1 wherein the metallic body is welded stainless steel tubing.

10. A process as set forth in claim 1 wherein the metallic body is stainless steel in a form of wire.

11. A process as set forth in claim 1 wherein the metallic body is stainless steel in a form of rod.

12. A process as set forth in claim 1 wherein the metallic body is stainless steel in a form of bar.

13. A process as set forth in claim 1 wherein the metallic body is stainless steel in a form of tubing.

* * * * *